US008295533B1

(12) United States Patent
Schachtman

(10) Patent No.: US 8,295,533 B1
(45) Date of Patent: Oct. 23, 2012

(54) BLUETOOTH HEADSET LANYARD SYSTEM

(76) Inventor: Steven I Schachtman, Weston, FL (US)

( * ) Notice: Subject to any disclaimer, the term of this patent is extended or adjusted under 35 U.S.C. 154(b) by 817 days.

(21) Appl. No.: 12/344,789

(22) Filed: Dec. 29, 2008

(51) Int. Cl.
*H04R 1/00* (2006.01)

(52) U.S. Cl. ..... 381/385; 381/374; 224/257; 248/316.5

(58) Field of Classification Search ..... 381/385, 381/374; 224/257; 248/316.5
See application file for complete search history.

(56) References Cited

U.S. PATENT DOCUMENTS

| | | | | |
|---|---|---|---|---|
| 3,452,976 | A * | 7/1969 | Ross | 269/91 |
| 5,460,347 | A * | 10/1995 | Schacher | 248/316.5 |
| 6,594,370 | B1 | 7/2003 | Anderson | |
| 2002/0090099 | A1 | 7/2002 | Hwang | |
| 2007/0175493 | A1 * | 8/2007 | Tandberg et al. | 132/275 |
| 2007/0278265 | A1 * | 12/2007 | Contente | 224/162 |
| 2008/0013778 | A1 | 1/2008 | Lee | |
| 2008/0143954 | A1 * | 6/2008 | Abreu | 351/158 |
| 2008/0196210 | A1 | 8/2008 | Liu et al. | |
| 2008/0222851 | A1 | 9/2008 | Rou | |
| 2009/0016559 | A1 * | 1/2009 | Cleary | 381/375 |
| 2010/0016037 | A1 * | 1/2010 | Maytum et al. | 455/575.2 |
| 2010/0206925 | A1 * | 8/2010 | Fielding, Jr. | 224/257 |

FOREIGN PATENT DOCUMENTS

WO 2007081072 7/2007

* cited by examiner

*Primary Examiner* — Tu-Tu Ho
(74) *Attorney, Agent, or Firm* — Gold & Rizvi, P.A.; Glenn E. Gold; H. John Rizvi

(57) ABSTRACT

A lanyard system for retaining a wireless headset has a strap and a slide affixed at a first end of the strap. The slide engages a portion of a length of the strap and forms a loop. The slide is adjustable along the length of the strap to adjust the size of the loop. An elastomeric retainer is affixed at a second end of the strap for selective attachment to a wireless headset for removably securing the wireless headset to the lanyard system.

12 Claims, 6 Drawing Sheets

BLUETOOTH HEADSET LANYARD SYSTEM

BACKGROUND OF THE INVENTION

1. Field of the Invention

The present invention relates to lanyards in general and more particularly to a lanyard and universal mounting system for retaining a Bluetooth headset.

2. Discussion of the Related Art

Bluetooth is a wireless protocol for exchanging data over short distances from fixed and mobile devices, creating personal area networks (PANs). The Bluetooth protocol was originally conceived as a wireless alternative to RS232 data cables. It can connect several devices, overcoming problems of synchronization. One of the most popular uses of the Bluetooth protocol is as a wireless headset for use with mobile telephones.

Such a wireless headset generally comprises a body and a means to retain the headset on the user's ear. The body of the wireless headset typically includes the operating electronics, a rechargeable battery, a microphone and a speaker. The speaker is coupled with an earpiece for directing the sound through the user's ear canal. The headset can be retained on the user's ear with an ear loop that hooks behind the user's ear much like the temple of a pair of eyeglasses. Other headsets are retained on the user's ear with the earpiece; the earpiece being of sufficient size to securely fit within a portion of the outer ear of the user.

The convenience of a wireless headset for use with mobile telephones is only realized by keeping the headset close to the user's body for immediate activation upon the receipt or placing of a telephone call. In order to keep the headset close, most individuals wear the headset attached to their ear without break. However, such wear can be uncomfortable from the weight of the headset, although minimal, and the fit and placement of the ear loop or earpiece. Consequently, some individual's remove the headset when not in use and keep it close by for when a call is incoming or is being placed. Unfortunately, removal of the headset often leads to misplacement or inconvenient placement when the individual desires to use the headset.

At least one lanyard having an attachment mechanism for holding a Bluetooth earpiece is known. However, the attachment mechanism is particularly designed for attachment to a specific earpiece design, and affixes directly to the body of the Bluetooth device with a fixed clip. It is not designed to enable attachment to multiple different earpiece configurations.

Thus, what is desired is a universal device that will retain wireless headsets, having myriad different constructions, on a user's body in a convenient location for immediate use.

SUMMARY OF THE INVENTION

The present invention is directed to a lanyard system that satisfies the need for a device to retain a wireless headset on a user's body in a convenient location for immediate use. The lanyard system has a strap and a slide affixed at a first end of the strap. The slide engages a portion of a length of the strap and forms a loop. The slide is adjustable along the length of the strap to adjust the size of the loop. An elastomeric retainer is affixed at a second end of the strap for selective attachment to a wireless headset for removably securing the wireless headset to the lanyard system.

Another aspect of the present invention is a lanyard system for retaining a wireless headset including a strap and an attachment at a first end of the strap. The attachment functions to attach the lanyard system to an article of a user's clothing.

A retainer is affixed at a second end of the strap for selective attachment to a wireless headset for removably securing the wireless headset to the lanyard system.

Yet another aspect of the present invention is a lanyard system for retaining a wireless headset including a strap and a slide affixed at a first end of the strap. The slide engages a portion of a length of the strap to form a loop. The slide is adjustable along the length of the strap to adjust a size of the loop. A butterfly clip is affixed at a second end of the strap. The butterfly clip has a pair of jaws biased in a closed position by a spring. Each of the jaws includes an elastomeric pad affixed to opposing surfaces of the jaws for gripping the wireless headset. One of the jaws has an electrical device integrated therewith.

These and other features, aspects, and advantages of the invention will be further understood and appreciated by those skilled in the art by reference to the following written specification, claims and appended drawings.

BRIEF DESCRIPTION OF THE DRAWINGS

For a fuller understanding of the nature of the present invention, reference should be made to the accompanying drawings in which.

Like reference numerals refer to like parts throughout the several views of the drawings.

DETAILED DESCRIPTION OF THE PREFERRED EMBODIMENT

Figure 1:
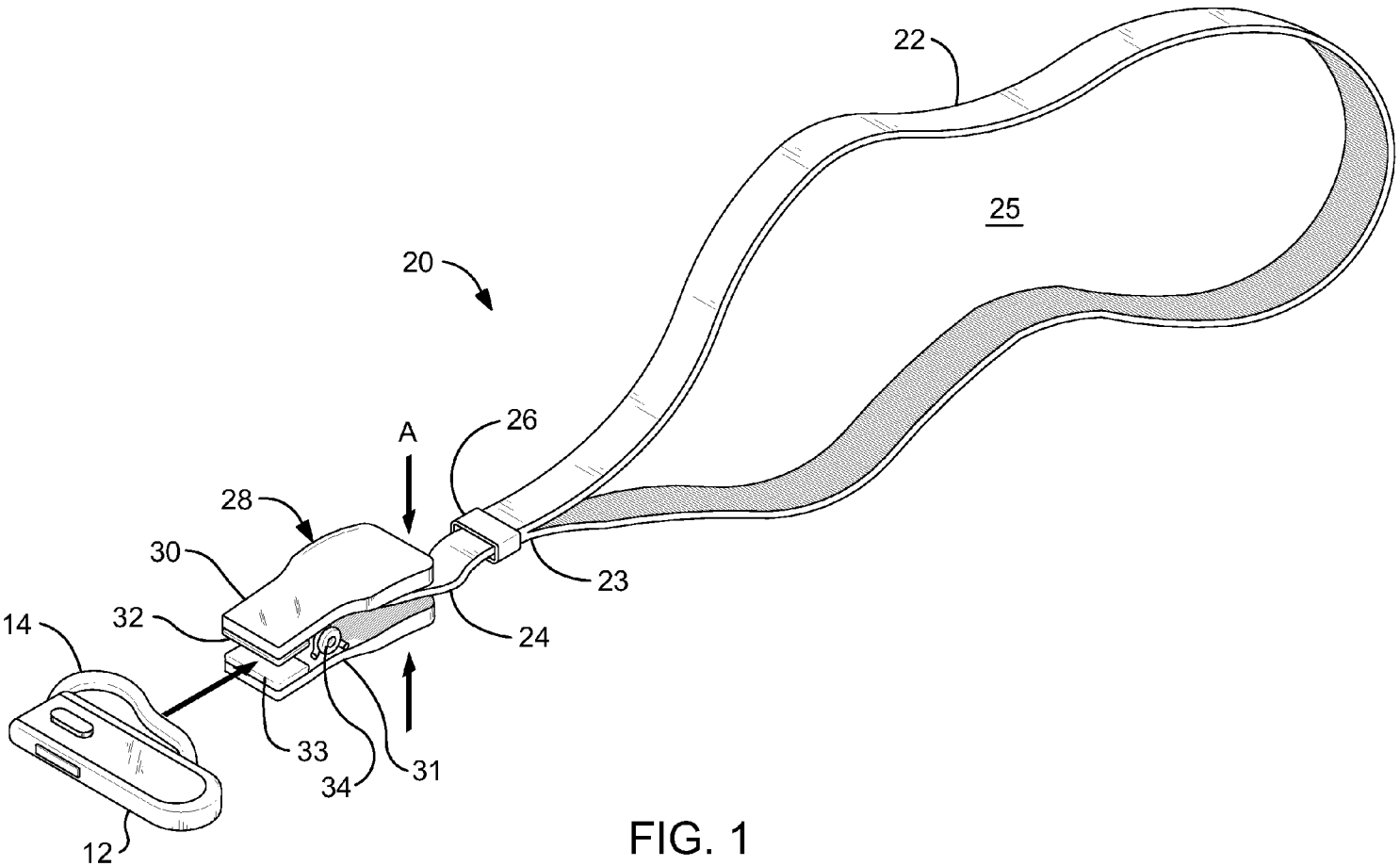
FIG. 1 is a perspective view of a lanyard for securing a Bluetooth headset embodying the present invention, wherein the Bluetooth headset earpiece is secured by an butterfly clip.

For purposes of description herein, the terms "upper", "lower", "left", "rear", "right", "front", "vertical", "horizontal", and derivatives thereof shall relate to the invention as oriented in FIG. 1. However, one will understand that the invention may assume various alternative orientations and step sequences, except where expressly specified to the contrary. Therefore, the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
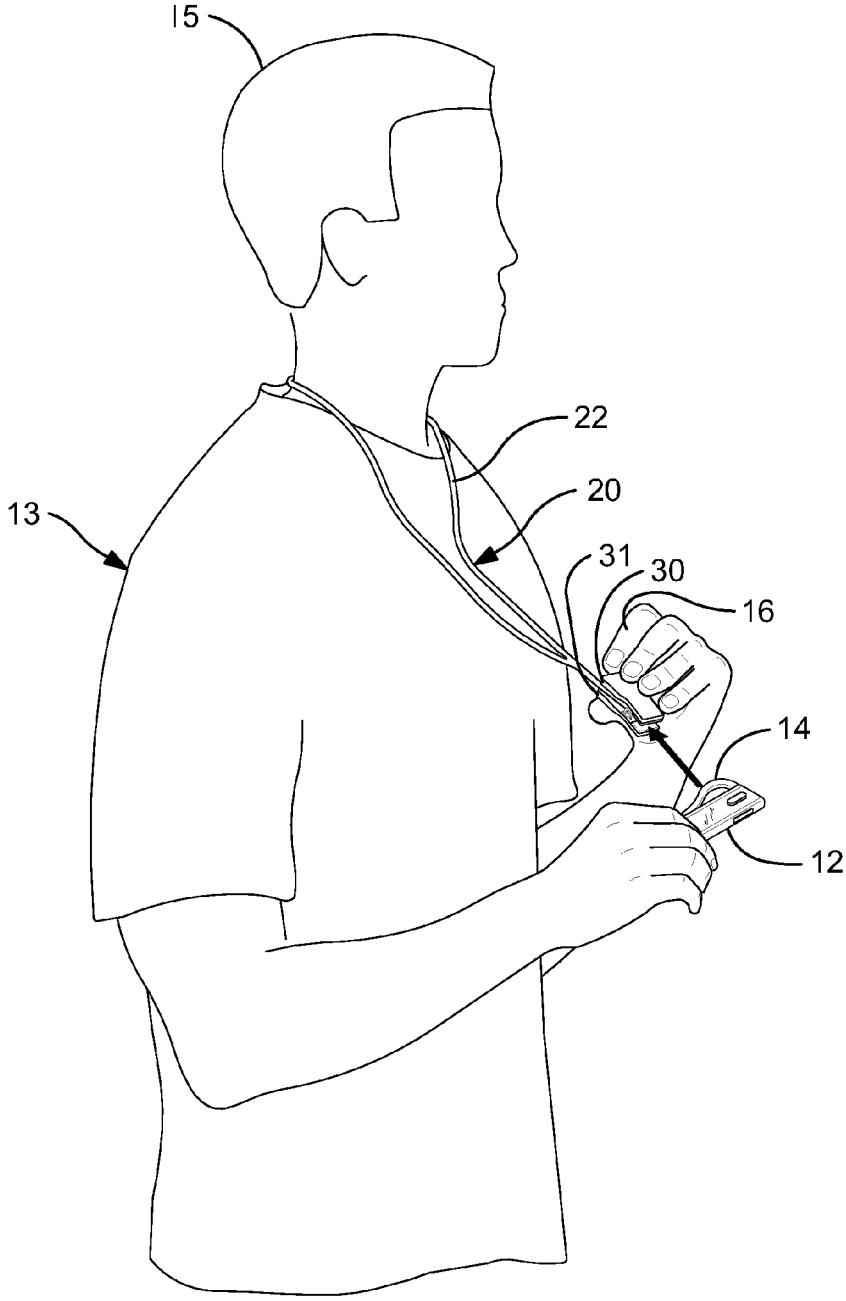
FIG. 2 is a perspective view of a user having the lanyard of FIG. 1 about his neck and in the process of securing a Bluetooth headset.

Turning to the drawings, FIGS. 1 and 2 show a lanyard system 20 which is one of the preferred embodiments of the present invention and illustrates its various components. Lanyard system 20 includes a strap 22 having a length sufficient to form a loop 25 of sufficient size to fit over the head 15 of a user 13 (FIG. 2). While strap 22 is shown as a long, narrow flat strip, those practiced in the art will readily recognize that strap 22 can be a cord, a string, a chain, or any other long, narrow flexible member. The term strap as used herein is considered to be inclusive of any long, narrow flexible members. Strap 22 has a slide 26 affixed to a first end 23 thereof. Slide 26 is shaped to closely engage a circumference of strap 22 to form loop 25 and is slidable along the length of strap 22 to adjust the size of loop 25.

Strap 22 has a second end 24 to which is affixed a retainer such as butterfly clip 28. Butterfly clip 28 includes first and second jaws 30, 31 which are pivotal one with respect to another and are biased in a closed position by a spring 34 in a commonly known configuration. Opposing faces of jaws 30, 31 have elastomeric pads 32, 33 affixed thereto respectively for securely grasping an element of headset 12.

In use, as illustrated in FIG. 2, a user 13 places loop 25 of lanyard system 20 over his head 15. Slide 26 can then be adjusted along the length of strap 22 to adjust lanyard system 20 according to the desires of user 13. To secure wireless headset 12 (typically a Bluetooth headset) user 13 grasps butterfly clip 28 and with his fingers 16 squeezes according to arrows "A" to open jaws 30, 31. He then places an element of wireless headset 12 such as earpiece 14 within open jaws 30, 31 of butterfly clip 28. User 17 then releases the opening force generated along arrows "A" to permit jaws 30, 31 to close and grasp the element of wireless headset between elastomeric pads 32, 33. In this manner, user 17 can keep wireless headset 12 nearby for immediate use upon the receipt or placement of a call with a telephone associated with wireless headset 12. When user 17 desires to use headset 12, he again squeezes butterfly clip 28 with his fingers 16 to release headset 12 for immediate use.

Figure 3:
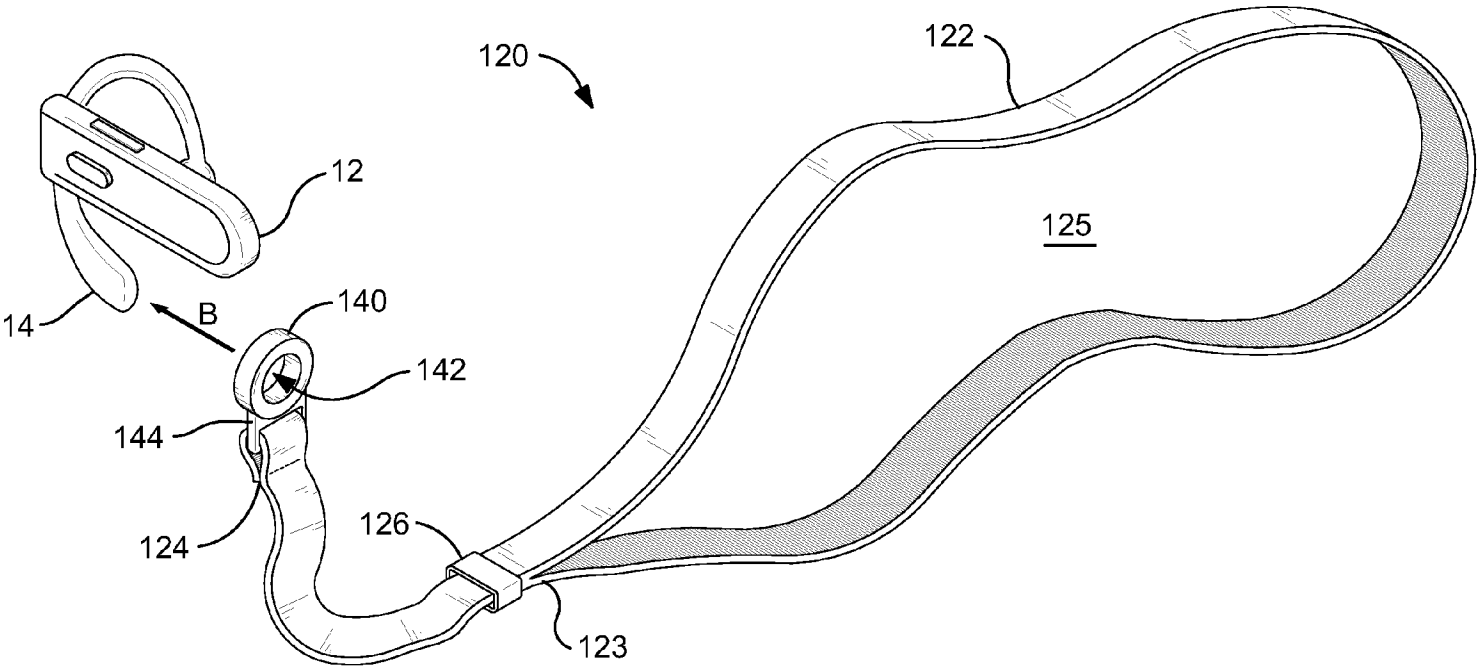
FIG. 3 is a perspective view of an alternate embodiment lanyard wherein the Bluetooth headset is secured by an elastomeric ring.

Turning now to FIG. 3, an alternate embodiment lanyard system 120 is shown. As described previously, lanyard system 120 includes a strap 122 having a slide 126 affixed to a first end 123 and forming a loop 125. Strap 122 has a second end 124 to which is affixed a retainer such as elastomeric loop 140. Elastomeric loop 140 includes a tab 144 for attachment to second end 124 of strap 122 and defines an opening 142 therethrough to receive an element of headset 12 such as earpiece 14 or the headset body.

In use, user 13 places lanyard system 120 over his head 15 and adjusts lanyard system 120 as described above. To secure wireless headset 12, user 13 slides elastomeric loop 140 over an element of headset 12 according to arrow "B". Opening 142 is typically of a smaller size than the element of headset 12 such as an end of earpiece 14 or sized to receive the body of headset 12. Elastomeric loop 140 is stretched to increase the size of opening 142 to allow passage of the element of headset 112 therethrough. When user 17 desires to use headset 12, he grasps elastomeric ring 142 in his fingers 16 and pulls elastomeric ring 140 in the opposite direction from arrow "B" allowing elastomeric ring 140 to stretch according to the size of the headset 12 element retained thereby until headset 12 is released.

Figure 4:
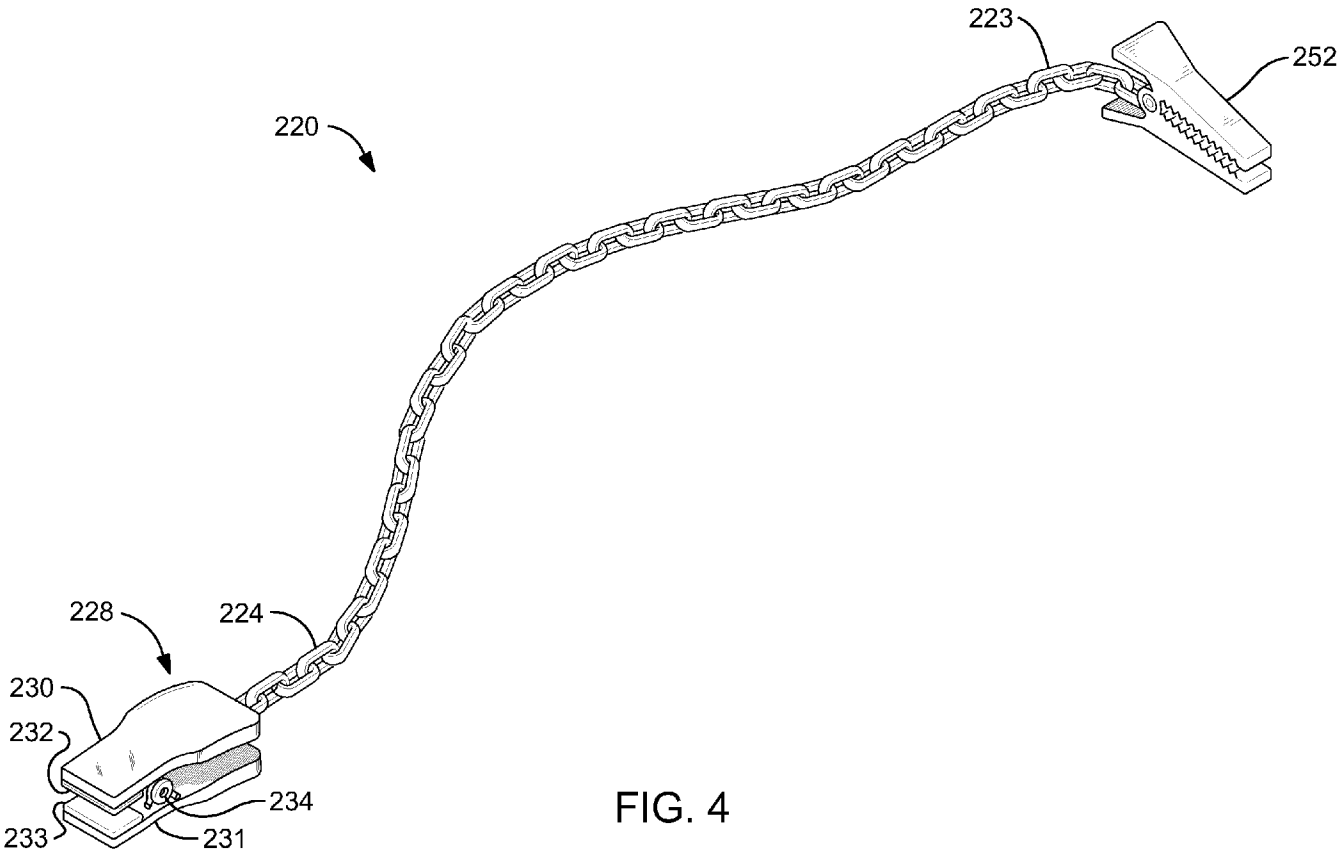
FIG. 4 is a perspective view of an alternate embodiment lanyard having an alligator clip at one end thereof.

FIG. 4 illustrates another lanyard system embodiment 220. Lanyard system 220 includes a length of chain 250 having a first end 223 to which is attached an attachment 252 such as an alligator clip. A second end 224 has affixed thereto a retainer such as butterfly clip 228 which is substantially identical in form and function to butterfly clip 28, above. Alternatively, the retainer utilized on lanyard system 220 can be an elastomeric ring which is substantially identical in form and function to elastomeric ring 140, above. Those practiced in the art will readily recognize that chain 250 can also take the form of a cloth or leather strap, a chord, or another like long narrow flexible member.

In use, user 17 affixes attachment 252 to an article of clothing and then attaches wireless headset 12 to the retainer either according to the manner described for butterfly clip 28, above or according to the manner described for elastomeric ring 140, above.

Figure 5:
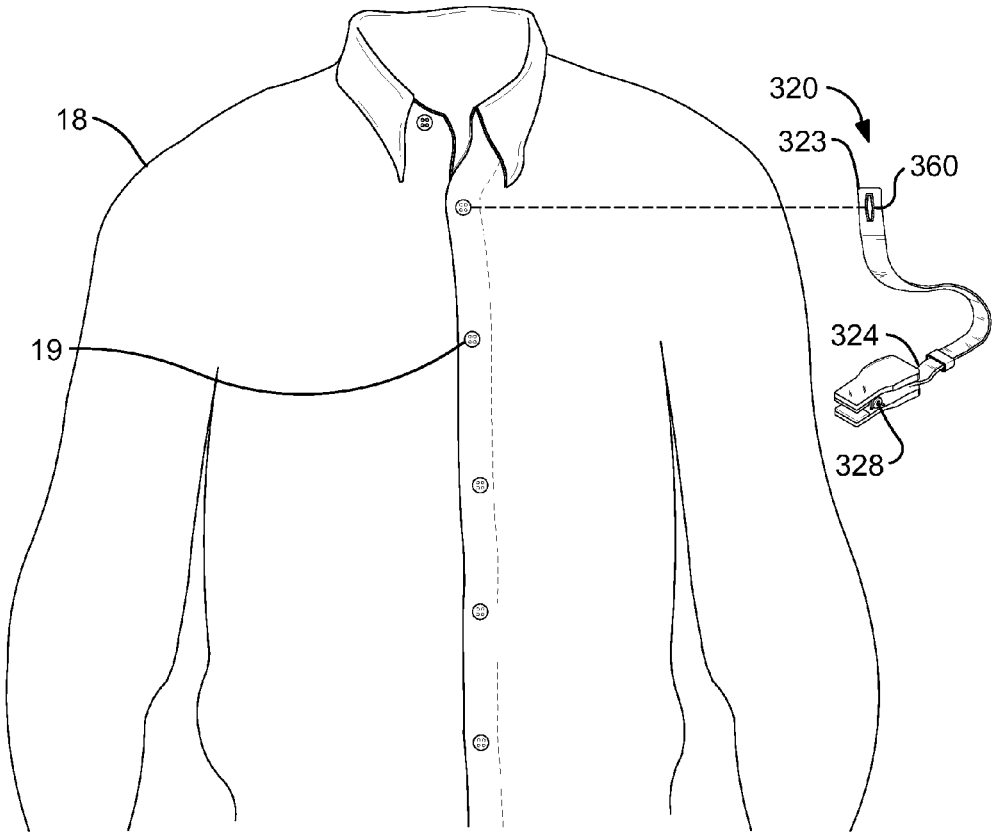
FIG. 5 is a perspective view of a lanyard having a button hole at one end for securing the lanyard to a shirt button.

Turning now to FIG. 5, yet another lanyard system embodiment 320 is shown and comprises a strap 322 having a first end 323 which defines a buttonhole 360. Strap 322 has a second end 324 to which is affixed a retainer such as butterfly clip 328 substantially identical in form and function to butterfly clip 28, above, or an elastomeric ring which is substantially identical in form and function to elastomeric ring 140, above. Strap 322 can have buttonhole 360 formed through strap 322 or, if strap 322 is a string or chord, buttonhole 360 can be formed as a loop at first end 323. In use, a button 19 of a user's shirt 18 is placed through buttonhole 360 to retain lanyard system 320 to the user's person. Butterfly clip 328 or elastomeric ring retainer are used in the same manner as described above.

Figure 6:
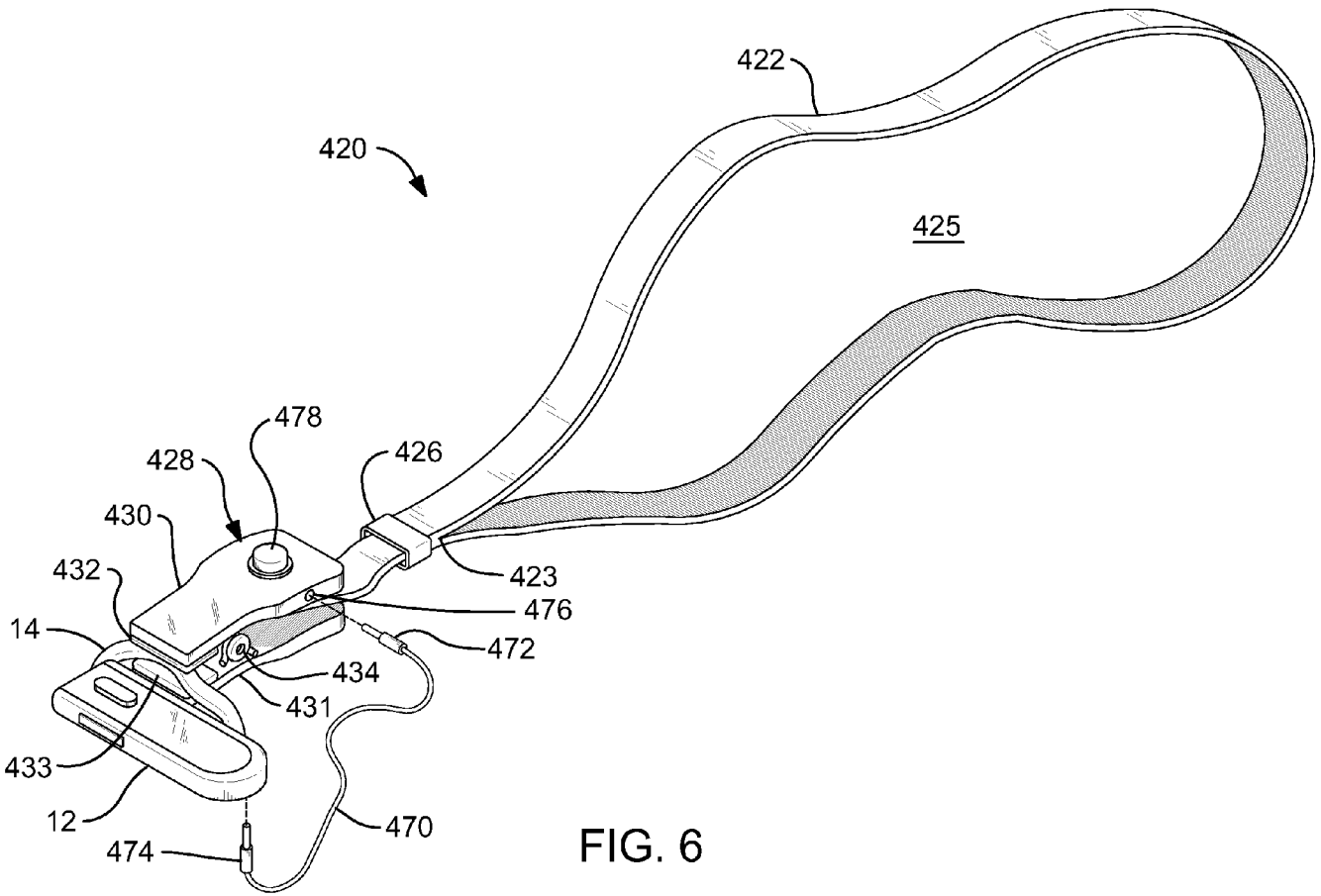
FIG. 6 is a perspective view of the lanyard of FIG. 1 incorporating a light on the butterfly clip that is powered by the battery of the Bluetooth headset.

FIG. 6 illustrates still another lanyard system embodiment 420. Lanyard system 420 is substantially the same as lanyard system 20 described above with like elements having like reference numerals preceded by the number "4". Lanyard system 420 also includes an electrical device 478 integrated with a butterfly clip jaw such as jaw 430. Jaw 430 includes a power receptacle 476. A power lead 470 has a first plug 472 at one end thereof and a second plug 474 at a second end thereof. First plug 472 is received in power receptacle 476 and second plug 474 is received in an electrical receptacle (not shown) of wireless headset 12 which has its earpiece 14 secured in jaws 430, 431 of butterfly clip 428. In this manner the battery of headset 12 can power the electrical device 478 in jaw 430. Electrical device 478 is here shown as a light such as a light emitting diode. When user 17 desires to use headset 12, he unplugs second plug 474 from headset 12 and releases earpiece 14 from jaws 430, 431.

The above description is considered that of the preferred embodiments only. Modifications of the invention will occur to those skilled in the art and to those who make or use the invention. Therefore, it is understood that the embodiments shown in the drawings and described above are merely for illustrative purposes and are not intended to limit the scope of the invention, which is defined by the following claims as interpreted according to the principles of patent law, including the doctrine of equivalents.

I claim:

1. A lanyard system for retaining a wireless headset, said lanyard system comprising:

a strap;

a portion of the strap formed into a loop; and a retainer affixed at a free end of said strap for selective attachment to a wireless headset for removably securing the wireless headset to said lanyard system, the retainer selected from a group consisting of:

(a) an elastomeric ring defining an opening and being resiliently stretchable to receive therethrough and retain an element of the wireless headset, and (b) a butterfly clip having a pair of jaws biased in a closed position by a spring and wherein each of said jaws includes an elastomeric pad affixed to opposing surfaces of said jaws, said elastomeric pads for gripping an element of the wireless headset; and wherein:

said lanyard system further includes an electrical device, said electrical device including a power lead for interfacing with a wireless headset for powering said electrical device from the battery of the wireless headset.

2. The lanyard system according to claim 1 wherein said ring is sized to receive an earpiece of the wireless headset.

3. The lanyard system according to claim 1 wherein said ring is sized to receive a body of the wireless headset.

4. The lanyard system according to claim 1 wherein said retainer is an elastomeric ring defining an opening and being resiliently stretchable to receive therethrough and retain an element of the wireless headset.

5. The lanyard system according to claim 1 wherein said retainer is a butterfly clip having a pair of jaws biased in a closed position by a spring and wherein each of said jaws includes an elastomeric pad affixed to opposing surfaces of said jaws, said elastomeric pads for gripping an element of the wireless headset.

6. The lanyard system according to claim 1 wherein said electrical device is a light.

7. A lanyard system for retaining a wireless headset, said lanyard system comprising:

a strap;

an attachment at a first end of said strap, said attachment for attaching said lanyard system to an article of a user's clothing; and a retainer affixed at a second end of said strap for selective attachment to a wireless headset for removably securing the wireless headset to said lanyard system; and wherein:

said lanyard system further includes an electrical device, said electrical device including a power lead for interfacing with a wireless headset for powering said electrical device from the battery of the wireless headset.

8. The lanyard system according to claim 7 wherein said electrical device is a light.

9. A lanyard system for retaining a wireless headset, said lanyard system comprising:

a strap;

a slide affixed at a first end of said strap, said slide engaging a portion of a length of said strap forming a loop wherein said slide is adjustable along said length of said strap to adjust a size of said loop; and a butterfly clip affixed at a second end of said strap, said butterfly clip having a pair of jaws biased in a closed position by a spring and wherein each of said jaws includes an elastomeric pad affixed to opposing surfaces of said jaws, said elastomeric pads for gripping an element of the wireless headset, and further wherein one of said jaws has an electrical device integrated therewith.

10. The lanyard system according to claim 9 wherein said butterfly clip retains an earpiece of a wireless headset between said jaws.

11. The lanyard system according to claim 10 further including an electrical lead interconnected between said wireless headset and said electrical device integrated into said lanyard system for providing electrical power from a battery in said wireless headset to said electrical device.

12. The lanyard system according to claim 11 wherein said electrical device is a light.

* * * * *